US011906261B1

(12) United States Patent
Mey et al.

(10) Patent No.: US 11,906,261 B1
(45) Date of Patent: Feb. 20, 2024

(54) MAGAZINE, WEAPON AND METHOD OF MANUFACTURING A MAGAZINE

(71) Applicant: MEY Chair Systems GmbH, Merlach (DE)

(72) Inventors: Dieter Mey, Bad Rodach (DE); Benedikt Mey, Untersiemau (DE); Tobias Mey, Sesslach (DE)

(73) Assignee: MEY CHAIR SYSTEMS GMBH, Sesslach/Merlach (DE)

( * ) Notice: Subject to any disclaimer, the term of this patent is extended or adjusted under 35 U.S.C. 154(b) by 0 days.

(21) Appl. No.: 17/876,599

(22) Filed: Jul. 29, 2022

(51) Int. Cl.

| | |
|---|---|
| ***F41B 5/14*** | (2006.01) |
| ***F41A 9/61*** | (2006.01) |
| ***F41A 9/54*** | (2006.01) |
| ***F41B 5/12*** | (2006.01) |

(52) U.S. Cl.
CPC ..... *F41B 5/126* (2013.01); *F41A 9/61* (2013.01); *F41A 9/54* (2013.01)

(58) Field of Classification Search
CPC .... F41B 5/126; F41A 9/54; F41A 9/55; F41A 9/56; F41A 9/61; F41A 9/65
USPC ..... 124/25.5, 25.7
See application file for complete search history.

(56) References Cited

U.S. PATENT DOCUMENTS 3,739,765 A * 6/1973 Moore ..... F41B 5/12 124/44.6
5,544,641 A * 8/1996 Jenn ..... F41G 1/467 124/52
6,868,845 B1 * 3/2005 Moore ..... F41B 5/10 124/25
10,663,249 B1 * 5/2020 Liu ..... F41B 5/126
2015/0233666 A1 * 8/2015 Rodich ..... F41B 5/126 124/52

(Continued)

FOREIGN PATENT DOCUMENTS

CN 201858931 U 6/2011
CN 114294998 A 4/2022

(Continued)

OTHER PUBLICATIONS

European Search Report corresponding to EP Patent Application No. 22187770.7 dated Jan. 9, 2023.

*Primary Examiner* — John E Simms, Jr.
(74) *Attorney, Agent, or Firm* — Jenkins, Taylor & Hunt, P.A.

(57) ABSTRACT

A magazine for storing and separating projectiles for a weapon, in particular for a bow weapon, includes a storage section, which is configured to house at least partially cylindrical projectiles, in particular arrows or bolts, and extends in a first direction. The magazine includes a separating mechanism coupled to the storage section. The separating mechanism includes an actuation section configured to be actuated by the movement of at least one actuation mechanism of a weapon when moved with respect to the first direction. The separating mechanism, upon actuation of the actuation section, is configured to separate a single projectile from a plurality of projectiles in the storage section. The separating mechanism includes a holding section configured to hold the separated single projectile with a predefined force in a launching area of a weapon. A weapon including such a magazine and a method for manufacturing such a magazine are also described.

17 Claims, 5 Drawing Sheets

(56) References Cited

U.S. PATENT DOCUMENTS

| | | | | |
|---|---|---|---|---|
| 2022/0113106 | A1* | 4/2022 | Blackstock | F41B 5/126 |
| 2022/0341698 | A1* | 10/2022 | Barnett | F41A 9/72 |

FOREIGN PATENT DOCUMENTS

| | | | |
|---|---|---|---|
| FR | 2680869 | A1 | 3/1993 |
| UA | 81295 | C2 | 12/2007 |

* cited by examiner

MAGAZINE, WEAPON AND METHOD OF MANUFACTURING A MAGAZINE

FIELD OF THE INVENTION

The present invention relates to a magazine, a weapon comprising such a magazine and a method of manufacturing such a magazine.

BACKGROUND OF THE INVENTION

Magazines for weapons are utilized for storing projectiles and in some cases feeding the stored projectiles to or towards a designated area of a weapon. Furthermore, wide varieties of specific applications for magazines exist, which in turn lead to a wide variety of different configurations and/or designs of said magazines. Additionally, the size, shape, material and purpose of the stored projectiles differ greatly and can for example range from small spherical projectiles for use in a BB- or Airsoft-gun to large elongate essentially cylindrical projectiles for use in bow weapons. Different materials and forms of projectiles require differently shaped magazines. Accordingly and in order to house or accommodate the different types of projectiles, magazines of different shapes and sizes exist. Furthermore, there are different constructive approaches for such a magazine. The most common type is a box-type magazine, based on vertical movement of the projectiles to feed the projectile towards the designated launching or firing area of a weapon. Furthermore, another type of magazine is a rotary magazine, which is based on rotation motion of the contained projectiles.

Furthermore, magazines are commonly used for repeating, semi-automatic or fully automatic weapons of different sizes and for different use cases. Moreover, different requirements for said magazines exist concerning their capacity, reliability, sealing, etc. Although the present invention and the underlying problem are described with reference to a bow weapon, they are not limited thereto, but they are transferable to a wide variety of types of weapons.

Bow weapons are commonly used without a magazine, but loaded manually. However, magazines for bow weapons do exist that are configured to hold a specific amount of projectiles. The projectiles are specific to bow weapons, for example arrows or bolts. There are even historic examples, so called repeater crossbows, which have been used in the Chinese Ming dynasty and had a top-mounted magazine containing a reservoir of bolts that are fed to the crossbow using gravity.

The magazines are configured to feed the projectiles to an area, where the projectiles are fired, launched or the like. The uniformity of the acceleration of the projectile plays a significant role in how well the projectile will be fired from the weapon. A further deciding factor is if and with what amount of contact pressure the projectile is held in place before being fired from the weapon.

Implementations of providing contact pressure upon the arrows lead to an uneven provision of said contact pressure, as it is dependent on the amount of arrows contained in the magazine. Consequently, this implementation does not allow for a satisfactorily adjustable and constantly deliverable contact pressure, for improved flight characteristics. Usually the problem with diminished flight characteristics is very noticeable when the magazine is nearing depletion.

SUMMARY OF THE INVENTION

Accordingly, the present invention has been made keeping in mind the above problems occurring in the related art, and it is an objective of the present invention is to provide a new and improved magazine, weapon and method of manufacturing a magazine.

According to the invention, this objective is solved by a magazine having the features of claim 1, a weapon having the features of claim 11, and a method of manufacturing a magazine having the features of claim 14.

Accordingly, the present invention provides:

A magazine for storing and separating projectiles for a weapon, in particular for a bow weapon, comprising: a storage section, which is configured to house a plurality of at least partially cylindrical projectiles, in particular arrows or bolts, and extends in a first direction, and a separating mechanism coupled to the storage section and comprising an actuation section configured to be actuated by the movement of at least one actuation mechanism of a weapon when moved with respect to the first direction, wherein the separating mechanism upon actuation of the actuation section is configured to separate a single projectile from a plurality of projectiles in the storage section, and the separating mechanism comprises a holding section configured to hold the separated single projectile with a predefined force in a launching area of a weapon.

A weapon, comprising a magazine according to the invention.

A method of manufacturing a magazine for storing and separating projectiles for a weapon, in particular a magazine according to the invention, comprising the steps of: Providing a storage section, which is configured to house a plurality of at least partially cylindrical projectiles and extends in a first direction; Providing a separating mechanism comprising an actuation section and a holding section, wherein the actuation section is configured to be actuated by movement of an actuation mechanism of a weapon when moved with respect to the first direction; Coupling the storage section and the separating mechanism in such a way that the separating mechanism can separate a single projectile from the plurality of at least partially cylindrical projectiles in the storage section when the actuation section is actuated, and that the holding section can hold the separated projectile in a predefined launching area of a weapon with a predefined force.

An underlying discovery on which the present invention is based is therefore that the projectiles in the magazine are not all forced together towards the launching area of a weapon.

An aspect of the present invention is therefore to separate a single projectile from a plurality of projectiles in order for the individual projectile to be held in a launching area of a weapon with a designated mechanism.

Advantageously, the invention results in a significantly improved magazine, which provides a predefined force on the separated projectile in the launching area of a weapon, independent from the number of projectiles housed in the storage section.

The predefined force provides contact pressure of the projectile, which has a large effect on the flight characteristics. In situations where the projectile experiences too little contact pressure, the projectile may become dislodged from the ideal or required position and in turn be fired in a disadvantageous manner. Similarly, the projectile does not receive sufficient stability prior to firing, which can have a negative influence on the flight characteristics. Furthermore, if the bow weapon completely lacks contact pressure, the projectile may fall out of position entirely while handling the bow weapon, as for example could happen while adjusting the bow weapon during outdoor use. Alternatively, if the contact pressure of the projectile is too high, the projectile may either not fire at all, since the contact pressure exceeds the firing force, or the projectile does not cover the desired distance, as the firing force is reduced by the too high contact pressure due to friction losses along the length of the projectile. The predefined force is configured to provide the ideal contact pressure of a projectile, prior to firing, in order to achieve ideal flight characteristics of the projectile.

In this regard, the user of a weapon experiences superior flight characteristics for every projectile in the magazine until its depletion. Additionally, the magazine according to the invention can utilized in situations where the importance of constant and reliable flight characteristics are of great importance, such as while hunting or during a sporting competition. In this way, a magazine with increased reliability and a robust applicability is provided.

Furthermore, no specific care has to be taken by the user while handling the magazine according to the invention with regard to the amount of projectiles remaining in the magazine, as the flight characteristics of the projectiles are not dependent on the fill state of the magazine. In this way, a more carefree application of a magazine is provided, which also results in less effort for the user while using a magazine according to the invention.

In particular, the storage section of the magazine can be configured to house a wide variety of different at least partially cylindrical projectiles, wherein the actually stored projectiles are all of a similar shape. For example, the storage section can be configured to house one of bolts, darts, quarrel, arrows or the like of different sizes and diameters. Additionally the projectiles configured to be housed in the storage section of the magazine can feature differently sized tips, vanes and/or nocks. The projectiles in particular can exhibit a length between approximately 10 cm to 60 cm, for a crossbow preferably 25 cm to 45 cm. Furthermore, the storage section can be formed as a rectangular or box volume having one long edge essentially extending in the first direction and two shorter edges extending essentially lateral thereto, even though further different shapes of the storage section are also possible. Advantageously, the actuation of the actuation section by the movement of at least one actuation mechanism of a weapon does not involve any complex adaptations or cumbersome alignments of the magazine and the actuation mechanism of a weapon. The actuation section of the separating mechanism may be configured to be adaptable to the wide variety of different actuation mechanisms, as the actuation mechanism of different weapons can differ greatly. The actuation of the actuation section can involve any movement of the actuation mechanism in a direction that is essentially aligned with the first direction. For example, the actuation mechanism of a weapon that actuates the actuation section of the separating mechanism can be configured as a slider, notch, guide, lever or similar component that is moveable. Furthermore, the shape and size of the actuation mechanism can vary greatly, and does not have to conform to any predefined constraints.

Furthermore, according to an embodiment, the storage section can be coupled to the separating mechanism by the means of a bracket or other form-fitting component. Additionally, the coupling of the two components can be fixed using common fastening elements, for example screws, bolts, rails, clamps or the like. Furthermore, the connection of the storage section and the separating mechanism can be releasable in order to be able to remove only a single component of the magazine in the case of the storage section and/or separating mechanism being in need to be repaired and/or serviced.

In particular, the first direction can be co-linear with the firing direction of a weapon with a magazine according to the current invention. Different alignments of the first direction and the firing direction of a weapon with a magazine according to the current invention are also possible. In this way, a versatile magazine is provided, which allows the user to appropriately configure the magazine for the desired use case.

Additionally, in an embodiment, the storage section can be configured to house the plurality of at least partially cylindrical projectiles in a single vertical column, wherein the projectiles are positioned essentially above and below each other. In another embodiment, the magazine is configured to house the projectiles in a staggered formation, wherein the projectiles are placed in two parallel and side-by-side columns that are essentially overlapping in order to increase the amount of projectiles that can be housed within a similarly dimensioned storage section of the magazine. In this way, a magazine with a higher capacity of projectiles is provided, which enables the user to utilize the magazine for a longer period before having to reload projectiles into the storage section.

Advantageously, the magazine comprises an attachment section configured to mount the magazine to a weapon, in particular a bow weapon, in a predefined position. The attachment section can be configured as a rail system, wherein the magazine can be sled onto the weapon and be fixed by the means of a fastening element, such as a screw, bolt or clamping system. Additionally, the attachment section of the magazine can be configured to be easily detachable from the weapon in order to modified, repaired and/or serviced.

Advantageously, the weapon is in particular a crossbow or the like. In the case of the weapon being configured as a crossbow the actuation of the actuation section can be carried out by a loading mechanism of said crossbow. The loading mechanism of a crossbow essentially involves the tensioning of the bowstring. The loading mechanism brings the bowstring of the crossbow from a not tensioned or loose state to a tensioned state, wherein the bowstring is kept in that tensioned state by a notch, nut or catch connected to a trigger. The loading mechanism itself may utilize a lever mechanism in order to ease or assist the tensioning process.

The method for manufacturing the magazine is in particular an assembly method or a method for assembling a magazine.

Advantageously, the comparatively small number of parts and the correspondingly low complexity of the steps to be carried out result in a very manageable method for manufacturing the magazine, which can be carried out by a single person. Preferably, the method of manufacturing the magazine can utilize a form-fitting mechanism and/or poka-yoke system in order to ensure correct orientation of the independent components to each other.

Advantageous designs and further embodiments result from the further dependent claims as well as from the description with reference to the figures of the drawing.

In an embodiment, the separating mechanism comprises at least two guides and at least two sliders. The guides are each configured to guide one of the sliders. Preferably, the respective guides are configured to allow the sliders to be guided and/or supported during the movement of the sliders.

Additionally, the guides may contain a pin or other protruding component attached to the sliders as a means of firstly securing the uniformity of the movement of the slider within the guide, secondly effectively avoiding jamming of the slider within the guide during its movement, and thirdly restricting the extent of the movement of the slider within the guide. The pin or other component can be configured as integral with the slider and at the same time as extending into an opening of the guide. In particular, the width of the slider covers a large portion, preferably between 70% and 90% of the width of respective guide and is dimensioned in accordance with the size of the projectile. Furthermore, the guides can act as protective cover of the sliders in order to shield and protect the sliders from external influences and from dirt during operation of a weapon with a magazine according to the current invention. The configuration of the guides effectively hinders small particles from entering, which could disrupt the movement of the sliders within the guides. In this way, a simple and effective mechanism is provided, which also exhibits high reliability and scalability.

According to another embodiment, the separating mechanism may contain four guides with four sliders in order to be applicable for use with larger projectiles and provide a predefined force for ideal contact pressure as well on the back as on the front end of a separated large projectile.

In a preferred embodiment, the sliders are configured to be moveable within the respective guides between a first position and a second position. The first position of the sliders corresponds to a closed state of the separating mechanism. In particular, the first position may be defined as a lowermost position within the guide, especially with respect to a vertical direction in use. The second position of the sliders corresponds to an open state of the separating mechanism. In particular, the second position may be defined as an uppermost position within the guide, especially with respect to a vertical direction in use. The separating mechanism is configured to be brought from the closed state to the open state upon actuation of the actuation section. In this way, the actuation of the actuation section causes the sliders to move, in particular upwards, from the first position to the second position, which essentially converts the separating mechanism from the closed state to the open state, allowing a single projectile to pass through the separating mechanism. The passing through of the single projectile is essentially a separating of a single projectile from the plurality of projectiles in the storage section. The separating mechanism can be configured to allow only one single projectile to be separated from the plurality of projectiles. Once the separating mechanism has separated a single projectile, the sliders are brought back, in particular downwards, into the first position and the separating mechanism is therefore converted back to the closed state, wherein the separated projectile completely separated from the plurality of projectiles in the storage section by the separating mechanism and held in the holding section. In this way, it is possible for the user or a device to bring the separating mechanism from the closed state to the open state by the means of the actuation section. The first and second position of the sliders can be configured in accordance with the size of the projectile in order to allow proper application of the separating mechanism. Additionally, the displacement between the first and second position of the sliders can be influenced by spacers or standoffs in order to modify the operation of the separating mechanism. Thus, an easy to use and modifiable mechanism to separate a single projectile from the plurality of projectiles in the storage section is provided.

In another preferred embodiment, the actuation section comprises a ramp integrated in the sliders and oriented oblique to the first direction, such that a movement of the actuation mechanism in parallel to the first direction and intersecting the ramp causes the sliders to move from the first position to the second position. In particular, movement of the actuation mechanism when intersecting the ramp lifts the sliders upwards. In this way, the movement of the actuation mechanism causes the separating mechanism to be brought from the closed position, corresponding to the first position of the sliders, to the open position, corresponding to the second position of the sliders. The shape and configuration of the ramp of the actuation section can be formed in accordance with the specific requirements of the magazine. For example, the ramp can be linear with a gradual or steep slope, but can also exhibit arc-shape. Furthermore, the actuation section can exhibit a symmetrical ramp, which allows the movement of the actuation mechanism, intersecting the actuation section, in the first direction and against the first direction, to cause the sliders to move from the first position to the second position. Preferably, the actuation section comprising the ramp is formed integral with the slider, but can also be configured as a component that can be coupled to the respective slider. Overall, an easily configured and carried out actuation of the actuation section is provided.

In a preferred embodiment, the holding section comprises a significantly concave end of the sliders, which is configured to correspond to the surface of the at least partially cylindrical separated projectile and securely hold it in the launching area of a weapon. In this way, the quality, reliability and safety of the hold is conveniently increased due to a high surface contact area provided by the concave end of the sliders. Preferably, the orientation of the concave end of the sliders is arranged in accordance with the movement of the sliders between the first and second position. Additionally, the dimensions and configuration of the concave ends can be adjusted for the specific use case and as such can be adapted in order to correspond to the surface of the at least partially cylindrical separated projectile. Preferably, the concave end of the sliders can feature a functional surface, which enables the concave end to provide an improved hold and/or grip of the separated projectile in the launching area of a weapon, for example by the means of surface treatment and/or a higher or adapted surface friction.

In another preferred embodiment, the sliders respectively are spring loaded, in particular at a spring-bearing end, arranged opposite to the significantly concave end. In this way, a simple component is provided, which effectively moves the sliders from the second position towards the first position after actuation of the actuation section and provides the predetermined force for holding the separated projectile in the launching area of a weapon. Preferably, the movement from the second position to the first position is carried out without requiring any further input from the user or a device. The spring-bearing end can be configured as a cylindrical recess within the surface of the slider opposite to the significantly concave end. Furthermore, the spring-bearing end can be configured to bear a spring or other component with elastic characteristics, which can be compressed during the movement of the slider from the first position to the second position and can decompress and/or expand in order to move the slider from the second position towards the first position, which in turn converts the separating mechanism from the open state to the closed state.

In another embodiment, the sliders are respectively spring-loaded by two springs, in particular helical springs, arranged in parallel, and wherein the springs are arranged within the respective spring-bearing ends of the sliders. In this way, an effective distribution of the elastic force of the respective springs is ensured. Thus, on the one hand, a distributed and uniform force is provided to the projectile through the, in particular significantly concave, ends of the sliders and on the other hand, a uniform motion of the sliders within the guides is guaranteed. The spring-bearing end of the sliders can be configured to house a wide variety of different springs and effectively compress the spring against the guide or another component during the movement of the slider from the first position towards the second position. Furthermore, the strength of the springs utilized to load the sliders is essentially similar to or in a predetermined relation, for example directly proportional, to the predefined force exerted on the projectile to hold it in a launching are of a weapon. In this way, the amount of force can be easily adjusted and controlled through the selection of the springs, their geometries and/or the interaction of the springs with the guides and/or sliders. Preferably, the amount of springs used for spring-loading the respective sliders is configurable and adaptable to the specific requirements of the magazine. Embodiments with only one spring and more than two springs are also possible.

In a preferred embodiment, the two sliders are essentially positioned at an angle to each other between 50° and 85°. Preferably, the angle is between 65° and 75° . In particular, the two sliders are positioned symmetrically. The two sliders are configured to be moveable, in particular also symmetrically, along the respective angles within the guides. In this way, a configuration and arrangement of the individual components is provided, which effectively enables the sliders and the separating mechanism to fulfill the desired function of separating and holding. The arrangement of the respective sliders at an angle and their movement along said angles from the first position to the second position causes the separating mechanism to be put into an open state, as the sliders essentially move away from each other in a horizontal and vertical direction. As a direct result of said movement of the sliders, a single projectile is in a first step separated and in a second step held with a predefined force in a launching area of a weapon, through the movement of the slider from the second position to the first position. In this way, the arrangement of the sliders at an angle enables the sliders to carry out both functions, converting the separating mechanism to an open state or closed state through the horizontal motion and holding the projectile through the vertical motion, especially with respect to a vertical direction in a use position.

In an embodiment, the magazine further comprises an opening configured for loading the at least partially cylindrical projectiles into the storage section of the magazine. The opening is arranged on the opposed side of the magazine with respect to the separating mechanism. In this way, the user can add and/or remove projectiles from the storage section of the magazine. Preferably, the opening is dimensioned in accordance with the dimension of the projectiles to be inserted into the storage section in order to simplify and assist the process of loading and unloading the magazine. The opening can be feature a cover or lid in order to shield the projectiles from external influences and/or from dirt during operation of a weapon with a magazine according to the current invention.

In a further embodiment, the magazine can alternatively be configured to be loaded with the at least partially cylindrical projectiles, in particular arrows or bolts, by means of or via the separating mechanism. Therefore, a user can load the projectiles into the storage section of the magazine by overcoming the predefined force of the holding section of the separating mechanism. In order to accomplish the loading of a projectile, the user moves the sliders from the second position towards the first position by pressing the projectile against the, preferably concave, end of the sliders, which essentially brings the separating mechanism into the open state. With the sliders in the second position, the single projectile that is to be loaded can pass the separating mechanism into the storage section, before the sliders return to the second position and the separating mechanism is reverted back to the closed state. This process can be repeated in order to fully load projectiles into the magazine up until the full capacity of the magazine is reached.

In a preferred embodiment, the magazine further comprises a spring-loading member arranged within the storage section and configured to exert a force in a second direction, in particular essentially perpendicular to the first direction, on the at least partially cylindrical projectiles such that the projectiles are bearing against the separating mechanism. In this way, a simple component is provided which ensures that the projectiles in the storage section are presented and/or urged towards the separating mechanism for separation, in particular irrespective of a fill state of the storage section. In some embodiments, the spring-loading member may be configured to allow the separating mechanism for separation even independent from gravity. The second direction can be essentially perpendicular to the first direction and/or the firing direction of a weapon with a magazine according to the present invention. Preferably, the spring-loading member exerts a force independent of the current orientation of the magazine, which ensures that the user can freely maneuver a weapon with a magazine according to the present invention without needing to orientate the magazine in a certain way. Additionally, the spring-loading member can be arranged as an independent component or as part of the cover in order to not negatively affect the loading process of the magazine. Preferably, the spring-loading member is configured as a leaf spring, but other types of components with elastic characteristics are possible.

In an embodiment, the storage section is configured to house at least 10, in particular between 10 and 15, preferably 12, at least partially cylindrical projectiles. In this way, the user of a weapon with a magazine according to the present invention has the ability to house a large amount of projectiles.

In a preferred embodiment of the weapon, the weapon is configured as a bow weapon, for example a crossbow, further comprising: a launching channel, and an actuation mechanism, wherein the magazine is configured upon actuation of the actuation section by movement of the actuation mechanism to separate an at least partially cylindrical projectile and deposit the separated projectile into the launching channel. In this way, a convenient and reliable weapon is provided, wherein the user of such a weapon has the ability to carry a large amount of projectiles and experiences improved flight characteristics of the fired projectiles up until the last projectile is shot.

In an embodiment of the weapon, the actuation mechanism is formed integral with a loading mechanism of the weapon configured to similarly load the weapon and actuate the actuation section of the separating mechanism. In this way, the user does not have to perform any additional procedures in order to fire a projectile from the weapon. Preferably, the weapon is a bow weapon and the loading mechanism of the weapon is configured as the tensioning mechanism of the bowstring of the bow weapon. Therefore and with the same motion, the separating mechanism separates the projectile, holds the projectile in the launching channel and the crossbow is cocked and ready to fire the projectile.

In an embodiment of the weapon, the weapon comprises an actuation mechanism configured as a lever and/or notch and coupled to the mechanism responsible for tensioning the weapon. In this way, while the bow is being brought from a not tensioned to a tensioned state, the actuation mechanism actuates the actuation section of the separating mechanism and a single projectile is separated and held in the launching area of said weapon. The actuation mechanism itself can also be configured as an aftermarket and highly flexibly applicable part, in order to avoid compatibility problems with different weapons.

According to a further embodiment of the weapon, the attachment section of the weapon is configured in such a way that the magazine can be attached to the weapon from below, i.e. upside down, wherein the separating mechanism is positioned at the uppermost end of the magazine and the opening is positioned at the lowermost end of the magazine. Furthermore, the separating mechanism is configured to separate a single projectile from a plurality of projectiles in the storage section, and the separating mechanism comprises a holding section configured to hold the separated single projectile with a predefined force, in particular against the gravitational direction, in a launching area of the weapon. Additionally, the plurality of projectiles within the storage section are bearing against the separating mechanism due to the spring-loading member. In this way, the separating mechanism can separate a single projectile from a plurality of projectiles in the storage section independently of gravity. According to another embodiment of the weapon, the attachment section of the weapon can be formed as a magazine well, in particular similar to a magazine well of a rifle or handgun, for attaching or inserting the magazine from below.

According to an embodiment of the method, the separating mechanism comprises at least two guides and at least two sliders, wherein the guides are each configured to guide one of the sliders, and wherein coupling the storage section and the separating mechanism comprises inserting the sliders into the guides, in particular in a spring-loaded manner. In particular, the movement of the sliders within the guides is restricted by the arrangement of a pin or other essentially cylindrical component that is integrated in the respective slider and reaches through an opening the respective guide. In this way, a simple and cost effective method of assembling the separating mechanism is provided that only requires a small amount of steps.

The above embodiments can be combined with each other as desired, if useful. Further possible embodiments, further configurations and implementations of the invention also include combinations, not explicitly mentioned, of features of the invention described herein with respect to the embodiments. In particular, the skilled person will thereby also add individual aspects as improvements or additions to the respective basic form of the present invention.

BRIEF DESCRIPTION OF THE DRAWINGS

For a more comprehensive understanding of the invention and the advantages thereof, exemplary embodiments of the invention are explained in more detail in the following description with reference to the accompanying drawing figures, in which like reference characters designate like parts and in which.

The accompanying drawings are included to provide a further understanding of the present invention and are incorporated in and constitute a part of this specification. The drawings illustrate particular embodiments of the invention and together with the description serve to explain the principles of the invention. Other embodiments of the invention and many of the resulting advantages of the invention will be readily appreciated as they become better understood with reference to the following detailed description.

It will be appreciated that common and/or well understood elements that may be useful or necessary in a commercially feasible embodiment are not necessarily depicted in order to facilitate a more abstracted view of the embodiments. The elements of the drawings are not necessarily illustrated to scale relative to each other. It will further be appreciated that certain actions and/or steps in an embodiment of a method may be described or depicted in a particular order of occurrences while those skilled in the art will understand that such specificity with respect to sequence is not actually required. It will also be understood that the terms and expressions used in the present specification have the ordinary meaning as is accorded to such terms and expressions with respect to their corresponding respective areas of inquiry and study, except where specific meanings have otherwise been set forth herein.

DETAILED DESCRIPTION OF EMBODIMENTS

Figure 1:
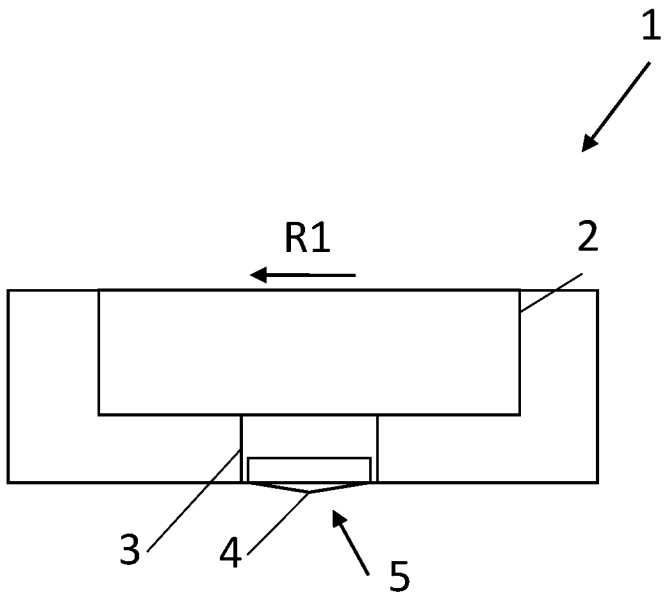
FIG. 1 shows a schematic representation of a magazine.

FIG. 1 shows a schematic representation of a magazine 1.

The magazine 1 is configured for storing and separating projectiles for a weapon 10, in particular for a bow weapon. The magazine comprises a storage section 2 and a separating mechanism 3. The storage section 2 is configured to house a plurality of at least partially cylindrical projectiles, in particular arrows or bolts.

The at least partially cylindrical projectiles can have a length between approximately 10 cm to 60 cm, for crossbow bolts preferably 25 cm to 45 cm. The storage section 2 extends in a first direction R1, which can be collinear with the firing direction of the weapon 10.

The separating mechanism 3 is coupled to the storage section 2 and comprises an actuation section 4, which is configured to be actuated by the movement of at least one actuation mechanism of a weapon when the actuation mechanism is moved with respect to the first direction R1. The separating mechanism 3 is configured to separate a single projectile from a plurality of projectiles in the storage section 2 upon actuation of the actuation section 4. Additionally, the separating mechanism 3 comprises a holding section 5, which is configured to hold the separated single projectile with a predefined force in a launching area of a weapon.

Figure 2:
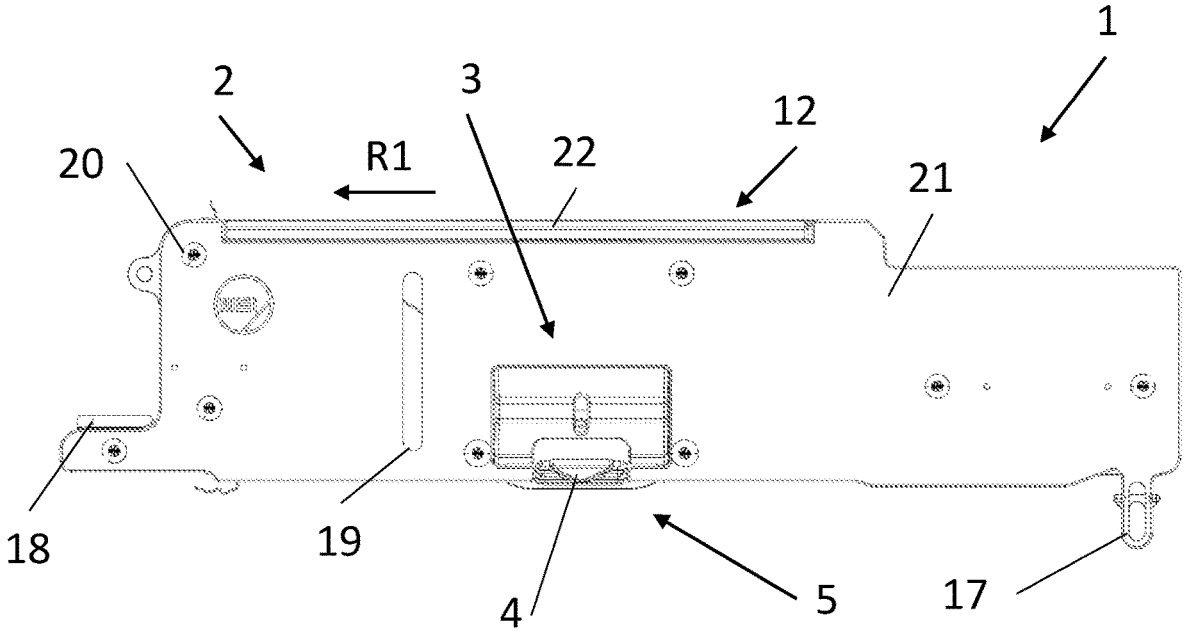
FIG. 2 shows a side view of a magazine according to an embodiment.

FIG. 2 shows a side view of a magazine 1 according to an embodiment.

This embodiment of a magazine 1 comprises a storage section 2 and separating mechanism 3. The functional relationship between the actuation mechanism of a weapon and the actuation section 4 of the separating mechanism 3 is the same as has been described with respect to FIG. 1.

The magazine comprises an opening 12 configured for loading the at least partially cylindrical projectiles into the storage section 2 of the magazine 1. As shown in FIG. 2, the opening 12 is arranged on the opposed side of the magazine 1 with respect to the separating mechanism 3. A cover 22 is configured to close the opening 12 during use of the magazine 1 and is configured to be easily removable and attachable in order to allow the user to add and/or remove projectiles. In addition, the cover 22 preferably covers the entire area of the opening 12 and provides a seal against dirt and/or dust.

In the shown embodiment, the magazine 1 comprises at least two sidewalls 21 on either side of the magazine 1 that essentially extend along the first direction R1. The sidewalls 21 comprise multiple fastening elements 20 configured to fixate the individual components of the magazine 1. The sidewall 21 additionally comprises a view port 19 configured to allow the user to view the amount of projectiles inside of the storage section 2, without having to remove the cover 22. The view port 19 is configured as an elongated hole that extends along the height of the storage section 2 and essentially perpendicularly to the first direction R1.

In addition and according to this embodiment, the magazine 1 comprises at least one mounting plate 18 and/or at least one mounting hole 17. In the shown embodiment, the mounting plate 18 is arranged on structural protrusion of the sidewall 21 that essentially extends in the first direction R1. The mounting hole 17 is also arranged on a structural protrusion of the sidewall 21 that essentially extends perpendicularly to the first direction R1. As shown, the mounting plate 18 and mounting hole 17 are arranged on opposite sides of the sidewall 21, and are each configured to receive a predefined fastening element configured to fixate the magazine 1 to a weapon 10. Embodiments with different mounting solutions are also be conceivable, for example with multiple latches or other fastening elements attached to the sidewalls 21 or other component.

The separating mechanism 3 is coupled to the storage section 2 and comprises an actuation section 4, which is configured to be actuated by the movement of at least one actuation mechanism of a weapon when the actuation mechanism is moved with respect to the first direction R1. In the shown embodiment, the actuation mechanism is essentially moved between the mounting hole 17 and mounting plate 18. Additionally, the separating mechanism 3 comprises a holding section 5, which is configured to hold the separated single projectile with a predefined force in a launching area of a weapon. In the shown embodiment, the holding section is arranged on the opposite side of the opening 12 and/or cover 22.

Figure 3:
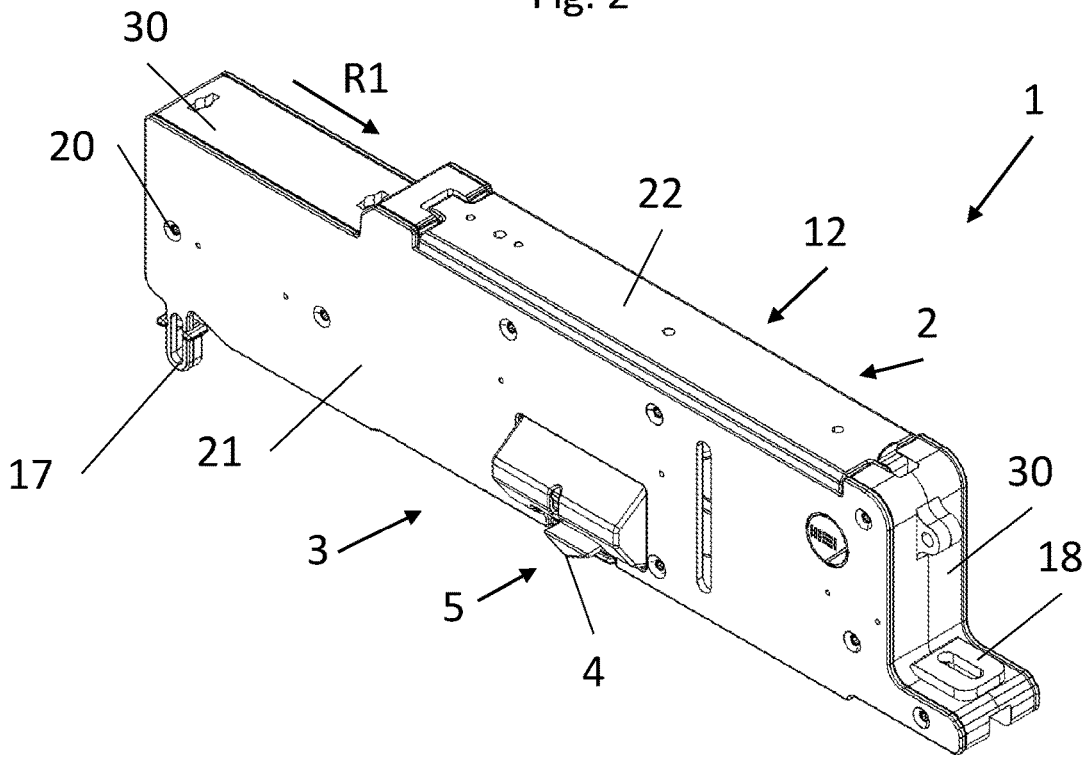
FIG. 3 shows a perspective view of the magazine according to FIG. 2.

FIG. 3 shows a perspective view of the magazine 1 according to FIG. 2.

In this view of the magazine 1 of FIG. 2, the mounting plate 18 is shown in more detail. The mounting plate 18 is configured to receive a fastening element in order to fixate the magazine 1 to a weapon. In the shown embodiment, the cover 22 of the opening 12 does not extend the entire length of the sidewall 21 in the first direction R1. The dimensions of the cover 22 and opening 12 can be configured in accordance with the dimensions of the projectiles. On either side of the storage section 2 the magazine comprises spacers 30 that act as end pieces of the magazine 1. The spacers 30 can be configured to perform a variety of functions, for example weight distribution, providing mounting points and/or other functions. In the shown embodiment, the mounting plate 18 is arranged on a spacer 30.

Figure 4:
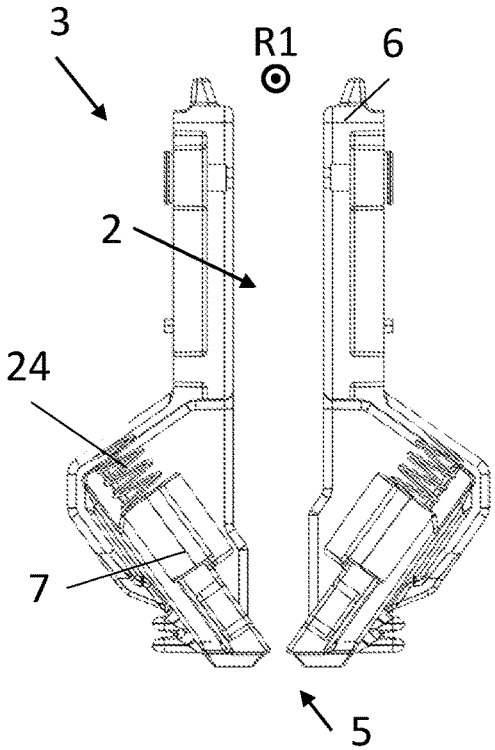
FIG. 4 shows a sectional view of a separating mechanism according to an embodiment.

FIG. 4 shows a sectional view of a separating mechanism 3 according to an embodiment. The first direction R1 is directed out of the shown plane.

The separating mechanism 3 comprises at least two guides 6 and at least two sliders 7. The guides 6 are each configured to guide one of the sliders 7. The guides 6 respectively comprise grooves in order to guide a flange 31 of the respective sliders 7. The movement of the slider 7 within the respective guides 6 follows the grooves.

In the shown embodiment, the individual sliders 7 are each spring-loaded by the means of a spring 24. The spring 24 is configured to spring-load the respective slider 7 against an inner wall of the respective guide 6. The inner wall of the respective guide 6 can be configured to receive the spring 24 in order to facilitate the spring-loading of the sliders 7. The shown springs 24 are configured as helical springs, but can also be configured as any different component, that exhibits elastic characteristics, for example a leaf spring or the like. The shown separating mechanism 3 comprises a holding section 5 that is arranged at the opposite end of the respective slider 7 with regard to the respective springs 24. The shown separating mechanism 3 is in the closed state and therefore a projectile cannot pass through the separating mechanism 3 from the storage section 2 to the holding section 5.

Figure 5:
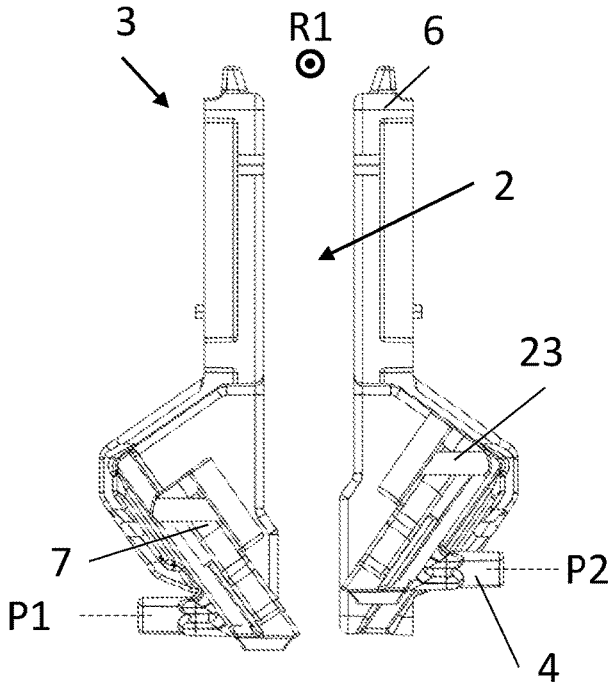
FIG. 5 shows a sectional view of the separating mechanism of FIG. 4 with a slider in the first position and another slider in the second position.

FIG. 5 shows a sectional view of the separating mechanism 3 of FIG. 4 with a slider 7 in the first position P1 and another slider 7 in the second position P2.

The shown embodiment contains a purely exemplary state of the separating mechanism 3 and does not show a regular state of the separating mechanism 3 during use of the magazine 1. The sliders 7 are configured to be moveable within the respective guides 6 between a first position P1 and a second position P2. The first position P1 of the sliders 7 corresponds to a closed state of the separating mechanism 3 and the second position P2 of the sliders 7 corresponds to an open state of the separating mechanism 3. The separating mechanism 3 is configured to be brought from the closed state to the open state upon actuation of the actuation section 4.

In the shown embodiment, the slider 7 in the guide 6 on the left side is in the first position P1, which is the lowermost position of the slider 7 within the guide 6. The slider 7 in the guide 6 on the right side is in the second position P2, which is the uppermost position with the guide 6. As shown, the slider 7 in the guide 6 on the left side is in a position, which hinders the passing of a projectile through the separating mechanism 3 by reducing the gap between the respective sliders 7. Alternatively, the slider 7 in the guide 6 on the right side is in a position, which facilitates the passing of a projectile through the separating mechanism 3 by increasing the gap between the respective sliders 7.

In addition, the separating mechanism 3 comprises a pin 23 arranged in a through hole of each slider 7 and a guide hole 32 of each guide 6. The pin 23 is configured to guide the respective slider 7 within the respective guide 6 between the first position P1 and the second position P2. The pin 23 and guide hole 32 facilitate the guiding of the respective slider 7 in addition to the flange 31 of the slider 7 and groove of the guide 6.

Figure 6:
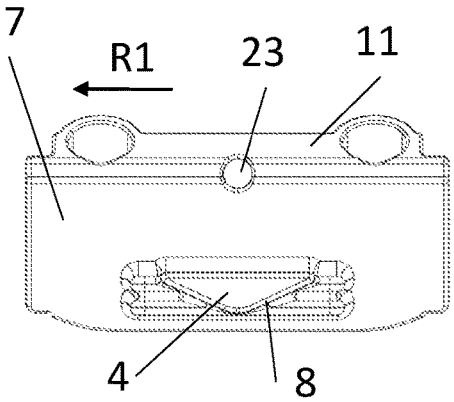
FIG. 6 shows a side view of a slider according to an embodiment.

FIG. 6 shows a side view of a slider 7 according to an embodiment.

The actuation section 4 comprises a ramp 8 integrated in the slider 7 and oriented oblique to the first direction R1. The ramp 8 is oriented in such a way that a movement of the actuation mechanism in parallel to the first direction R1 and intersecting the ramp 8 causes the sliders 7 to move from the first position P1 to the second position P2.

In the shown embodiment, the actuation section 4 comprises two ramps 8 arranged on opposite sides of the actuation section 4 in order to allow actuation of the actuation section 4 by the movement of the actuation mechanism in the first direction R1 and against the first direction R1. The slider 7 comprises a spring-bearing end 11, which comprises two cylindrical recesses arranged on either side of the pin 23. The two cylindrical recesses are configured to receive the springs 24. The incline of the ramp 8 corresponds to the displacement between the first position P1 and second position P2 of the slider within the respective guide 6.

Figure 7:
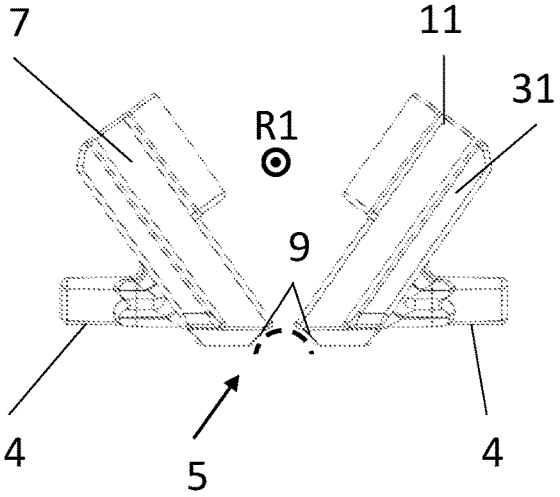
FIG. 7 shows a side view of two sliders according to FIG. 6.

FIG. 7 shows a side view of two sliders 7 according to FIG. 6.

In the shown embodiment, the holding section 5 of the separating mechanism 3 comprises a significantly concave end 9 of the sliders 7, which is configured to correspond to the surface of the at least partially cylindrical separated projectile and securely hold the single projectile in the launching area of a weapon. The respective concave ends 9 of the sliders 7 in the shown closed state of the separating mechanism 3 essentially form a half circle. This is indicated by the exemplary dotted half circle that shows the top half of a sectional view of a projectile arranged in the first direction R1 and in the holding section 5. This arrangement of the sliders 7 and the shape of their respective concave ends 9 is crucial for performing the function of the holding section 5, and is configured to provide a large surface area for contacting the projectile.

Additionally, the actuation section 4 essentially extends perpendicularly to the first direction R1 and simultaneously away from the respective holding section 5 of the separation mechanism 3. In this way, the actuation section 4 provides a large area and/or width in order to be actuated by an actuation mechanism of a weapon.

In addition, the respective concave ends 9 of the slider 7 are arranged opposite to the respective spring-bearing ends 11. As shown in the embodiment, the sliders 7 comprise a flange 31, which is configured to guide the slider 7 in the grooves of the respective guides 6. Furthermore, the two sliders 7 are essentially positioned, in particular symmetrically, at an angle to each other of approximately 70°. The two sliders 7 are configured to be moveable, in particular symmetrically, along the respective angles within the guides 6. Embodiments with different angles between the sliders 7 are also conceivable, for example angles of between 55° and 85°.

Figure 8:
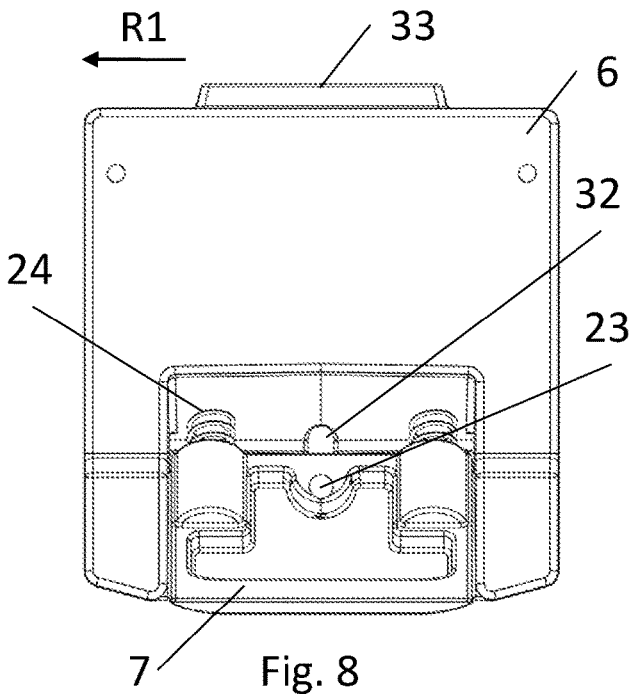
FIG. 8 shows a side view of a separating mechanism according to FIG. 4.

FIG. 8 shows a side view of a separating mechanism 3 according to FIG. 4.

The shown embodiment of a separating mechanism 3 is in the closed state and comprises a single guide 6 and slider 7 with two springs 24 arranged in parallel and inserted in the spring-bearing end 11. In addition, the slider 7 comprises a pin 23 arranged in the guide hole 32 of the guide 6.

The slider 7 is configured to moveable within the guide 6 from the shown first position P1 to the second position P2 by the actuation of the actuation section 4 by an actuation mechanism of a weapon. Upon actuation of the actuation section 4, the slider moves upwards and compresses the spring 24 arranged in the spring-bearing ends 11 of the slider 7. In the same way, the pin 23 moves upwards within the guide hole 32 in order to avoid jamming and/or wedging of the slider 7 within the guide 6.

In addition, the guide 6 comprises a lip 33. The lip 33 is configured as an angled protrusion that extends towards the opening 12 and facilitates the loading of projectiles into the storage section 2.

Figure 9:
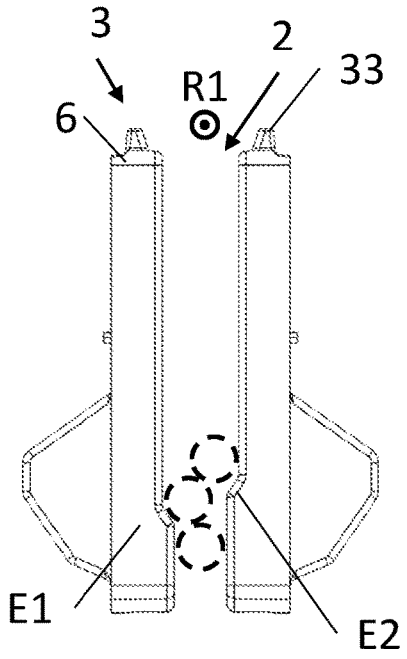
FIG. 9 shows a front view of two guides according to an embodiment.

FIG. 9 shows a front view of two guides 6 according to an embodiment.

The guides 6 respectively comprise a lip 33 that as previously stated is configured as an angled protrusion.

In addition, the guide 6 on the left side comprises an edge E1 and the guide 6 on the right side comprises an edge E2.

The edges E1, E2 are configured as angled surfaces arranged on an inner side of the respective guides 6. The edge E1 is at a lower height with respect to the edge E2 in order to stagger the projectiles, which are to be loaded into the storage section 2 of the magazine. The staggered formation of the projectiles essentially forms two parallel and side-by-side columns that are essentially overlapping in order to increase the amount of projectiles that can be housed within the storage section 2 of the magazine 1. This staggered formation of the projectiles is shown by the exemplary dashed circles that represent projectiles inside of the storage section 2 of the magazine 1. The staggered formation of the projectile enables the storage section 2 to be configured to house at least 10, in particular between 10 and 15, preferably 12, projectiles.

Embodiments with different arrangements or configurations of the respective edges E1, E2 are also conceivable, for example edges E1, E2 with curved slopes.

Figure 10:
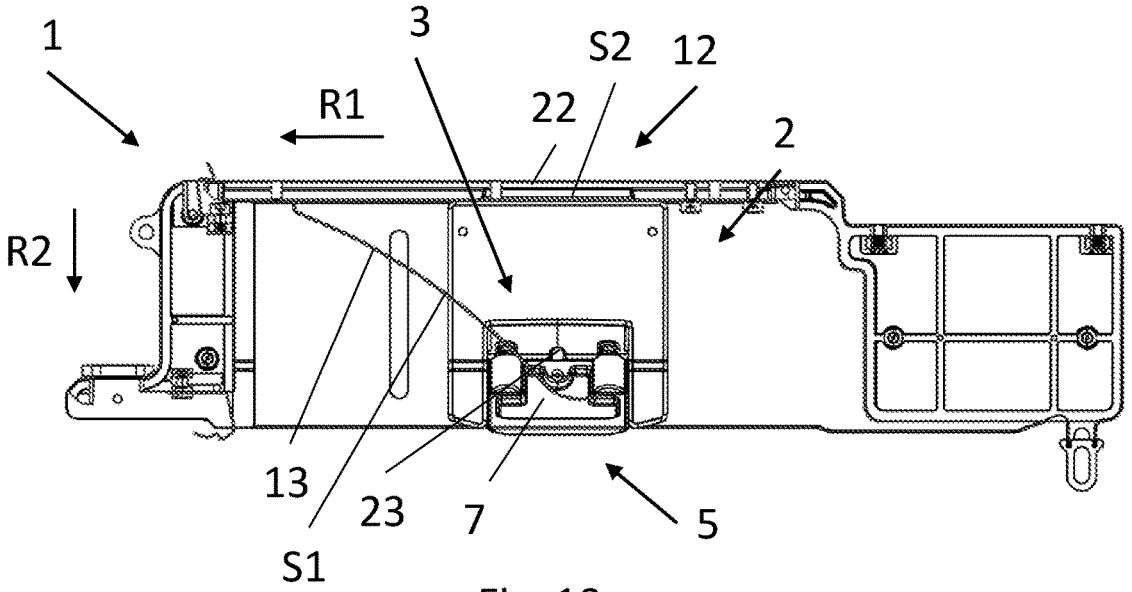
FIG. 10 shows a sectional view of a magazine according to FIG. 2.

FIG. 10 shows a sectional view of a magazine 1 according to FIG. 2.

The magazine 1 comprises a storage section 2 and separating mechanism 3. Furthermore, the magazine 1 comprises a spring-loading member 13 arranged within the storage section 2 and configured to exert a force in a second direction R2. The spring-loading member 13 exerts the force on the at least partially cylindrical projectiles such that the projectiles are bearing against the separating mechanism 3. The second direction R2 is in particular essentially perpendicular to the first direction R1.

In the shown embodiment, the spring-loading member 13 is configured as a leaf spring, but other types of components with elastic characteristics are possible. The spring-loading member 13 is essentially configured as a component with two shanks S1, S2. A first shank S1 is arranged in parallel to first direction R1 and essentially integrated in the opening 12 and/or cover 22. The second shank S2 extends from a bend point of the spring-loading member 13 between the first and second shank S1, S2 towards the holding section 5 and essentially in the second direction R2.

In the shown embodiment, while loading projectiles into the storage section 2 through the opening 12, the spring-loading member 13 and the cover 22 are removed. Once the loading process has ended the spring-loading member 13 and the cover 22 are reattached to the magazine 1 and the spring-loading member 13 is compressed. This compression causes the spring-loading member 13 to exert a force on the at least partially cylindrical projectiles in the storage section 2 such that the projectiles are bearing against the separating mechanism 3 and holding section 5.

Figure 11:
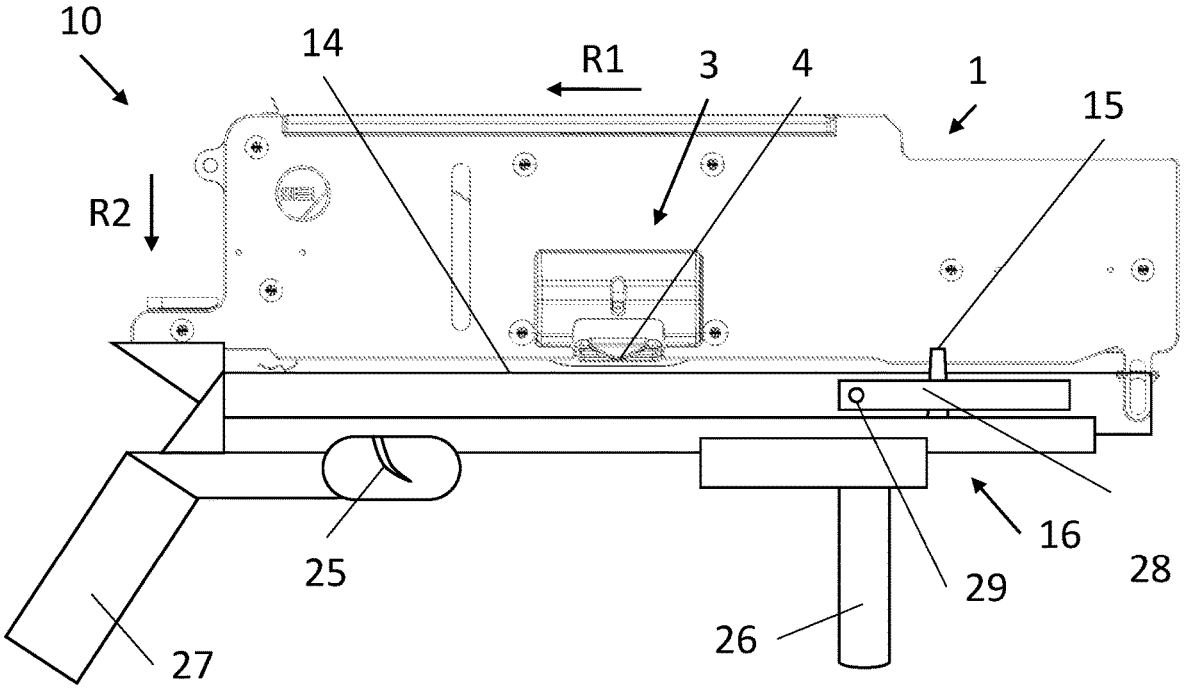
FIG. 11 shows a side view of a weapon according to an embodiment.

FIG. 11 shows a side view of a weapon 10 according to an embodiment.

The weapon 10 comprises a magazine 1 according to the embodiment shown in FIG. 2 and is configured as a bow weapon. The weapon 10 further comprises a launching channel 14 and an actuation mechanism 15. The magazine 1 is configured upon actuation of the actuation section 4 by movement of the actuation mechanism 15 to separate an at least partially cylindrical projectile and deposit the separated projectile into the launching channel 14.

The actuation mechanism 15 of the weapon 10 is configured as a lever, which essentially extend against the second direction R2 and is formed integral with a loading mechanism 16 of the weapon 10. The loading mechanism 16 is configured to similarly load the weapon and actuate the actuation section 4 of the separating mechanism 3. The loading mechanism 16 loads the weapon by tightening the bowstring 29 held by the pawl 28 and moves the bowstring 29 in the first direction R1. Once the bowstring 29 has been tightened and the separating mechanism 3 of the magazine holds a projectile in the launching channel 14 of the weapon 10, the projectile can be shot from the weapon 10 upon actuation of the trigger 25.

The weapon 10 additionally comprises a grip 27 and fore grip 26 in order to safely and securely maneuver the weapon 10 with the magazine 1 while in use.

Although specific embodiments of the invention are illustrated and described herein, it will be appreciated by those of ordinary skill in the art that a variety of alternative and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

The invention claimed is:

1. A magazine for storing and separating projectiles for a weapon, comprising:

a storage section, which is configured to house a plurality of at least partially cylindrical projectiles, in particular arrows or bolts, and extends in a first direction, and a separating mechanism coupled to the storage section and comprising an actuation section configured to be actuated by the movement of at least one actuation mechanism of a weapon when moved with respect to the first direction, wherein the separating mechanism upon actuation of the actuation section is configured to separate a single projectile from a plurality of projectiles in the storage section, and wherein the separating mechanism comprises a holding section configured to hold the separated single projectile with a predefined force in a launching area of a weapon, wherein the separating mechanism comprises at least two guides and at least two sliders, and wherein the guides are each configured to guide one of the sliders, wherein the sliders are configured to be moveable within the respective guides between a first position and a second position, wherein the first position of the sliders corresponds to a closed state of the separating mechanism and the second position of the sliders corresponds to an open state of the separating mechanism, wherein the separating mechanism is configured to be brought from the closed state to the open state upon actuation of the actuation section, and wherein the actuation section comprises a ramp integrated in the sliders and oriented oblique to the first direction, such that a movement of the actuation mechanism in parallel to the first direction and intersecting the ramp causes the sliders to move from the first position to the second position.

2. The magazine according to claim 1, wherein the holding section comprises a significantly concave end of the sliders, which is configured to correspond to the surface of the at least partially cylindrical separated projectile and securely hold it in the launching area of a weapon.

3. The magazine according to claim 1, wherein the sliders respectively are spring loaded.

4. The magazine according to claim 2, wherein the sliders are spring loaded at a spring-bearing end arranged opposite to the significantly concave end.

5. The magazine according to claim 1, further comprising a spring-loading member arranged within the storage section and configured to exert a force in a second direction on the at least partially cylindrical projectiles such that the projectiles are bearing against the separating mechanism.

6. The magazine according to claim 5, wherein the second direction is essentially perpendicular to the first direction.

7. The magazine according to claim 1, wherein the storage section is configured to house at least 10 at least partially cylindrical projectiles.

8. The magazine according to claim 1, wherein the magazine is configured for a bow weapon.

9. The magazine according to claim 1, wherein the storage section is configured to house a plurality of projectile configured as arrows or bolts.

10. A magazine for storing and separating projectiles for a weapon, comprising:

a storage section, which is configured to house a plurality of at least partially cylindrical projectiles, in particular arrows or bolts, and extends in a first direction, and a separating mechanism coupled to the storage section and comprising an actuation section configured to be actuated by the movement of at least one actuation mechanism of a weapon when moved with respect to the first direction, wherein the separating mechanism upon actuation of the actuation section is configured to separate a single projectile from a plurality of projectiles in the storage section, and wherein the separating mechanism comprises a holding section configured to hold the separated single projectile with a predefined force in a launching area of a weapon, wherein the separating mechanism comprises at least two guides and at least two sliders, and wherein the guides are each configured to guide one of the sliders, and wherein the two sliders are essentially positioned at an angle to each other between 55°and 85°, and wherein the two sliders are configured to be moveable along the respective angles within the guides.

11. The magazine according to claim 10, wherein the two sliders are positioned symmetrically and configured to be moveable symmetrically.

12. A magazine for storing and separating projectiles for a weapon, comprising:

a storage section, which is configured to house a plurality of at least partially cylindrical projectiles, in particular arrows or bolts, and extends in a first direction, and a separating mechanism coupled to the storage section and comprising an actuation section configured to be actuated by the movement of at least one actuation mechanism of a weapon when moved with respect to the first direction, wherein the separating mechanism upon actuation of the actuation section is configured to separate a single projectile from a plurality of projectiles in the storage section, and wherein the separating mechanism comprises a holding section configured to hold the separated single projectile with a predefined force in a launching area of a weapon, further comprising an opening configured for loading the at least partially cylindrical projectiles into the storage section of the magazine, wherein the opening is arranged on the opposed side of the magazine with respect to the separating mechanism.

13. A weapon, comprising:

a magazine for storing and separating projectiles for the weapon, the magazine comprising:

a storage section, which is configured to house a plurality of at least partially cylindrical projectiles and extends in a first direction, and a separating mechanism coupled to the storage section and comprising an actuation section configured to be actuated by the movement of at least one actuation mechanism of the weapon when moved with respect to the first direction, wherein the separating mechanism upon actuation of the actuation section is configured to separate a single projectile from a plurality of projectiles in the storage section, and wherein the separating mechanism comprises a holding section configured to hold the separated single projectile with a predefined force in a launching area of the weapon, wherein the separating mechanism comprises at least two guides and at least two sliders, and wherein the guides are each configured to guide one of the sliders, wherein the sliders are configured to be moveable within the respective guides between a first position and a second position, wherein the first position of the sliders corresponds to a closed state of the separating mechanism and the second position of the sliders corresponds to an open state of the separating mechanism, wherein the separating mechanism is configured to be brought from the closed state to the open state upon actuation of the actuation section, and wherein the actuation section comprises a ramp integrated in the sliders and oriented oblique to the first direction, such that a movement of the actuation mechanism in parallel to the first direction and intersecting the ramp causes the sliders to move from the first position to the second position.

14. The weapon according to claim 13, wherein the weapon is configured as a bow weapon, further comprising:

a launching channel, and an actuation mechanism, wherein the magazine is configured upon actuation of the actuation section by movement of the actuation mechanism to separate an at least partially cylindrical projectile and deposit the separated projectile into the launching channel.

15. The weapon according to claim 13, wherein the actuation mechanism is formed integral with a loading mechanism of the weapon configured to similarly load the weapon and actuate the actuation section of the separating mechanism.

16. A weapon, comprising:

a magazine for storing and separating projectiles for the weapon, the magazine comprising:

a storage section, which is configured to house a plurality of at least partially cylindrical projectiles and extends in a first direction, and a separating mechanism coupled to the storage section and comprising an actuation section configured to be actuated by the movement of at least one actuation mechanism of the weapon when moved with respect to the first direction, wherein the separating mechanism upon actuation of the actuation section is configured to separate a single projectile from a plurality of projectiles in the storage section, and wherein the separating mechanism comprises a holding section configured to hold the separated single projectile with a predefined force in a launching area of the weapon, wherein the separating mechanism comprises at least two guides and at least two sliders, and wherein the guides are each configured to guide one of the sliders, wherein the two sliders are essentially positioned at an angle to each other between 55°and 85° , and wherein the two sliders are configured to be moveable along the respective angles within the guides.

17. A weapon, comprising:

a magazine for storing and separating projectiles for the weapon, the magazine comprising:

a storage section, which is configured to house a plurality of at least partially cylindrical projectiles and extends in a first direction, and a separating mechanism coupled to the storage section and comprising an actuation section configured to be actuated by the movement of at least one actuation mechanism of the weapon when moved with respect to the first direction, wherein the separating mechanism upon actuation of the actuation section is configured to separate a single projectile from a plurality of projectiles in the storage section, and wherein the separating mechanism comprises a holding section configured to hold the separated single projectile with a predefined force in a launching area of the weapon, the magazine further comprising an opening configured for loading the at least partially cylindrical projectiles into the storage section of the magazine, wherein the opening is arranged on the opposed side of the magazine with respect to the separating mechanism.

* * * * *